US005199366A

United States Patent [19]

Ranchi

[11] Patent Number: 5,199,366

[45] Date of Patent: Apr. 6, 1993

[54] HIGH-SPEED BOAT

[76] Inventor: Otto Ranchi, 6, rue de l'Est, Geneva, Switzerland

[21] Appl. No.: 445,731

[22] PCT Filed: May 25, 1988

[86] PCT No.: PCT/EP88/00468

§ 371 Date: Jan. 24, 1990

§ 102(e) Date: Jan. 24, 1990

[87] PCT Pub. No.: WO88/09283

PCT Pub. Date: Dec. 1, 1988

[30] Foreign Application Priority Data

May 25, 1987 [DE] Fed. Rep. of Germany ..... 3717548

[51] Int. Cl.[5] ..... B63B 1/20

[52] U.S. Cl. ..... 114/56; 114/291

[58] Field of Search ..... 114/56, 271, 291, 123, 114/356, 357

[56] References Cited

U.S. PATENT DOCUMENTS

| | | | |
|---|---|---|---|
| 2,544,599 | 3/1951 | Keelen | 114/123 X |
| 2,634,698 | 4/1953 | Becker | 114/291 |
| 3,303,809 | 2/1967 | Ross | 114/56 |
| 3,808,999 | 5/1974 | Peterson | 114/56 |
| 4,909,176 | 3/1990 | Kobayashi | 114/123 X |

FOREIGN PATENT DOCUMENTS

| | | |
|---|---|---|
| 40195 | 1/1971 | Australia . |
| 2098136 | 11/1982 | United Kingdom . |

*Primary Examiner*—Sherman Basinger

*Attorney, Agent, or Firm*—Townsend and Townsend

[57] ABSTRACT

A fast watercraft has a central body (11), the V-shaped bottom frames (15) of which become flatter from the foreship towards the stern. In the stern region two mutually symmetrical lateral annexes (12) having chine-like frames are arranged on the central body (11) with the base frames (13*a* to 13*e*) of the lateral annexes having the same or a smaller inclination to the horizontal than the bottom frames (15*e* to 15*i*) in the same vertical frame plane.

27 Claims, 2 Drawing Sheets 0
1
2
3
4
5
6
7
8
11
12
14
16
17
19
20
21
22
23
24
I 0
1
2
3
4
5
6
7
8
11
12
12'
12''
14
17
18
19
20
21
22
23

HIGH-SPEED BOAT

BACKGROUND OF THE INVENTION

The invention relates to a fast watercraft with a central body having chine-type frames, the V-shaped bottom frames of which become flatter from the fore part towards the stern.

It is already known (DE-PS 687 340) to form the foreship of a watercraft as a displacement body in the quiet state and to arrange a planing surface, at the stern, wholly in the flow which is influenced by the displacement body during travel, in such a way that the planing surface can no longer be affected by direct motion of the sea. The displacement body which is kept as narrow as possible and which only supplies a small part of the buoyancy during travel is thus a wave damper and a flow guiding device. The planing surface, which is kept as broad as possible and needs only a slight keel is the main carrying element.

Planing watercraft are also generally known. The increase in the speeds that are demanded and thus of the machine power which has to be accommodated has, on the one hand, led to great problems of the drive systems in customary boat forms which are difficult to solve, and, on the other hand, to the development of new propulsion systems with the customary forms no longer being suitable for the accommodation and ideal hydrodynamic use of new propulsion systems.

The invention is based on the object of providing a fast watercraft of the initially named kind which, on the one hand, has the advantages of a planing craft but which simultaneously makes possible the ideal use of modern propulsion systems.

SUMMARY OF THE INVENTION

In order to satisfy this object the invention provides that two mutually symmetrical lateral annexes which likewise have chine-type frames are arranged on the central body in the middle region to the stern region, with the bottom frames of the lateral annexes having the same inclination or a smaller inclination relative to the horizontal than the bottom frames in the same vertical frame plane.

As a result of the invention the large supporting surface in the planing state is achieved which is necessary to attain the high speeds which are aimed at. Moreover, the high required drive powers lead to a concentration of weight in the rear part of the ship or hull, with a large dynamic buoyancy being necessary to achieve the planing state in order to overcome the static weight, which likewise assumes a large planing surface.

The invention is distinguished from the delta shapes used to broaden the stern by the fact that the hydrodynamic disadvantages associated herewith do not occur. These disadvantages lie in the fact that sufficient buoyancy is no longer produced, in particular in the outer zones of the triangular region, i.e. in the zone within the chine in the frames, and that pronounced eddies arise and thus the danger is present o unstable behaviour at high speeds and with the sea in motion.

In place of this, in accordance with the present invention, the enlargement of the buoyancy surface is achieved by the sensibly balanced addition of two lateral annexes which structurally form a unit with the central body. In this way it is possible, on the one hand, to keep the width of the watercraft within limits and, on the other hand, the outwardly disposed zones can be much better used, through the shaping of the lateral annexes to generate the necessary dynamic buoyancy.

In particular the design of the bottom shape of the lateral annexes enables a gradual transition from a rise angle which corresponds substantially to that of the central body to a rise angle of 0°, i.e. to bottom end surfaces of the lateral annexes which are arranged horizontally which in this manner deliver the maximum possible dynamic buoyancy and, moreover, avoid broadening which increases further towards the stern with the resulting hydrodynamic disadvantages and the presence of a still positive rise angle.

In the static floating state the presence of the lateral annexes already acts favourably on the trim of the watercraft as more volume is available in the stern region to support the motors and the drive elements. On increasing the speed of travel to attain the planing state the latter arises earlier with the aid of the present invention because the two lateral annexes begin to generate the desired additional buoyancy even at relatively low speeds due to their longitudinal inclination. Finally, through the presence of the lateral annexes and the ideally balanced shaping between the central body and the lateral annexes, the best possible dynamic trim can be achieved at the highest possible speeds and and excessively large trim such as is in inherent in many planing craft can be avoided and the existing power can be exploited through reduction of the total resistance for the dynamic buoyancy instead of for producing a large trim.

Through this shaping one is able to influence the shape of the sectional area curve so that the best possible trim results statically and hydrodynamically and so that the position of the center of gravity which results therefrom is always ideal.

Through the avoidance of excessively wide delta shapes of the aid of the present invention it is moreover possible to reduce the total resistance by reducing the path of the water particles along the hull of the watercraft to a minimum. From this it can be seen that it is desirable to make the central body and also the lateral annexes as parallel as possible to the central axis and also in their lateral boundaries relative to one another.

The most expedient arrangement of the lateral annexes from the point of view of length and height results from considerations concerning the pressure distribution at the bottom surfaces having regard to the avoidance of zones of negative pressure, which can easily occur with planing boat shapes and which lead to power and speed losses, and also have the consequence of a reduction of the course stability. With the aid of the present invention it is possible to keep the floor pressure positive and substantially constant in all planing zones using simple means.

Moreover, the invention makes it possible to optimise the seaworthiness which is essentially achieved by the shaping in the foreship of the central body, whereas with the aid of the lateral annexes the weight distribution and the static and also dynamic stability can be optimised via the moments of inertia of the waterlines and the existing power can be exploited through reduction of the total resistance to increase the dynamic buoyancy instead of generating a large trim.

Whereas the central body is a chine-type frame shape with the inclination of the base increasing gradually towards the stem, with the angle of inclination of the frames in the bottom region being always larger than 0°, the two lateral annexes which start approximately at the center of the length of the watercraft have a knuckle line which differs from that of the central body and frame angles, i.e. rise angles of the two parts which gradually reduce to the value of 0° at the stern end from a maximum value at the position of entry. Towards the stern, the lateral annexes can terminate with the same transom as a central body but can however also project beyond the latter.

The lateral annexes are moreover so designed that their bottom is set at an angle in the longitudinal direction relative to the horizontal base line which always endows them with the function of quoins which is known per se. This angle of attack in the longitudinal direction can be constant or can however also change continuously with constant tendency. Moreover, the lowest points of the lateral annexes are always above the lowest points of the central body.

The central body is moreover so designed that its sidewalls above the knuckle line and behind the sharpened shape of the foreship always remain parallel to the central plane and also to one another, while the lateral annexes likewise have sidewalls adjoining the sharpened shape of their starting portions which remain parallel to the central plane and to those of the central body.

The combination of the central body with the lateral annexes makes it possible to allow the frame cross-sectional areas to increase towards the stern away from the foreship and thus to achieve a frame area curve of essentially triangular character, such as would be the case for a hull in delta shape. In comparison, however, the design of the invention has the advantage of the largest possible adaptability to the hydrodynamic and constructional circumstances through the combination of the form elements.

The combination of the hydrodynamic effects of the subject of the invention makes adaptation possible to the requirements of speed, seaworthiness and also to the constructional circumstances, and indeed always in that part of the overall hull which remains underwater during the change of trim of the vehicle which occurs during travel, in particular in the region of that zone in which the frame inclinations of the central body and of the lateral annexes, i.e. the two rises, are of the same size and extend in a continuous line.

The invention will be described in the following with reference to the drawing in which are shown:

DESCRIPTION OF THE PREFERRED EMBODIMENTS

Figure 1:
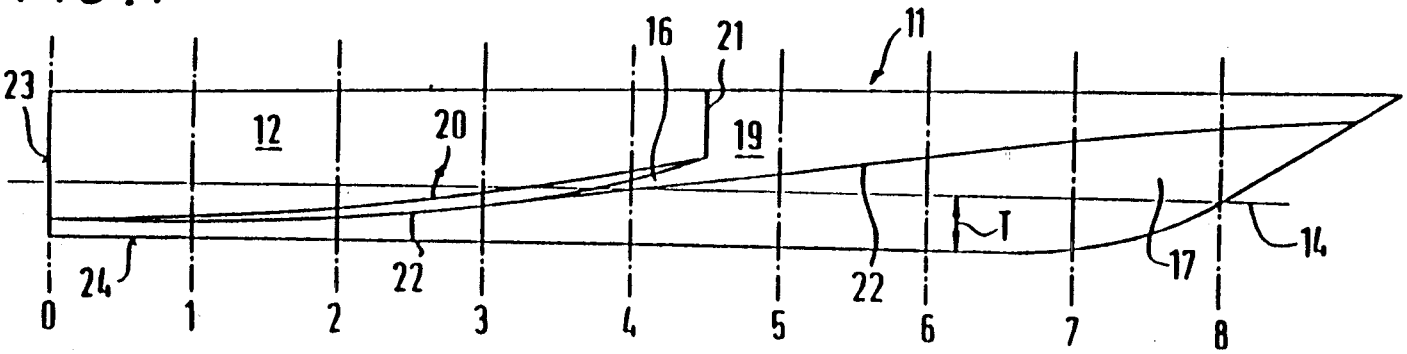
FIG. 1 a schematic sideview of a fast watercraft in accordance with the invention with details of the frames 0 to 8 which are distributed over the length of the ship, FIG. 2 a schematic plan view of the fast watercraft of the invention, likewise with details of the frames 0 to 8 which are distributed over the ship's length, FIG. 3 the one half of the frame 0, FIG. 4 in each case one half of the frames 1 and 2, FIG. 5 in each case one half of the frames 3 and 4, FIG. 6 in each case one half of the frames 5 and 6, and FIG. 7 in each case one half of the frames 7 and 8.

In accordance with the drawing the fast watercraft of the invention has a central body 11 to which two mutually symmetrical lateral annexes 12 are attached approximately from the middle of the ship to the stern. The draught beneath the line of rotation 14 is designated by T.

The central body 11 has a tip 17 and merges, approximately at frame 6 into a region with side boundaries or sidewalls 19 which extend parallel to one another and vertically. In accordance with FIGS. 3 to 7 the central body 11 has chine-type frames with the bottom frames 15*a*, 15*b*, 15*c*, 15*d*, 15*e*, 15*f*, 15*g*, 15*h* and 15*i* having an inclination which reduces in a direction from the foreship to the stern. Whereas the foremost frame 8 has an inclination of approximately 50° relative to the line of rotation 14, the inclination of the last bottom frame 15*i* of the central body to the horizontal is approximately 10°.

The knuckle line 22 of the frames of the central body 11 begins at the tip 17 far above the line of flotation 14 and then approaches the line of flotation 14 in the direction of the aftship with slight upward convex curvature, with the knuckle line 22 intersecting the line of flotation 14 in the region of the start of the lateral annexes 12, at an angle in the range of 15°–25° preferably at an angle of 15°, in order to then extend beneath the line of rotation 14 slightly curved in the opposite direction to the stern 23 of the watercraft where it terminates close to the keel 24.

In accordance with FIGS. 3 to 6 the lateral boundaries 19 of the central body 11 are vertical and parallel to one another in particular in the region where the lateral annexes 12 adjoin the central body 11.

In accordance with the drawing the lateral annexes 12 also have a chine-type frame shape, with the bottom frames 13*a*, 13*b*, 13*c*, 13*d* and 13*e* first extending at the same angle as the bottom frames 15*e*, 15*f*, 15*g* of the central body but then however being flatter in the region of the central body bottom frames 15*h*, and 15*i* (FIGS. 3, 4) than the central body bottom frames and forming an angle between them of no more than 20°, and preferably in the range of between 10°–15°, Further, the inclination of the bottom frame 15*a* in the region of where the lateral annexes start is in the range of 10°–45°, with about 30° being presently preferred. Finally, the inclination of the bottom frame 15*i* at the stern also is 10°–45°.

The knuckle line 20 of the lateral annexes 20 starts approximately at the center of the ship at a vertical knuckle line 21 along which the lateral annexes 12 start to project laterally out of the central body 11 at an angle in the range of 15°–40°, preferably of about 25°–30°.

Figure 5:
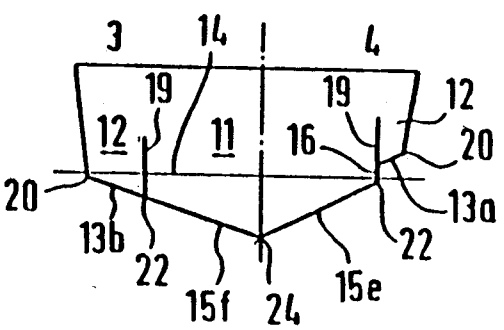
Figure 4:
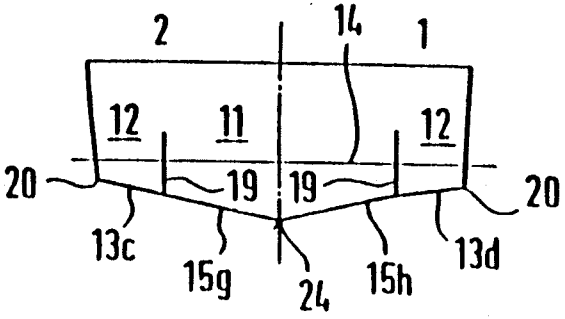
Figure 3:
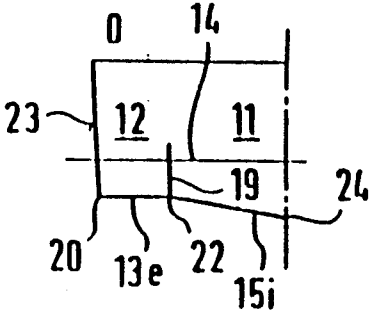
Figure 7:
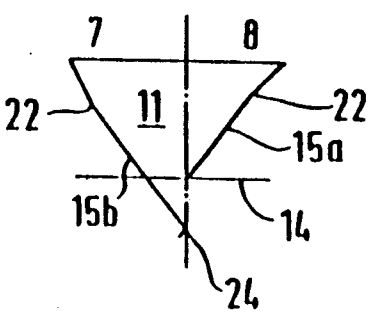
Figure 6:
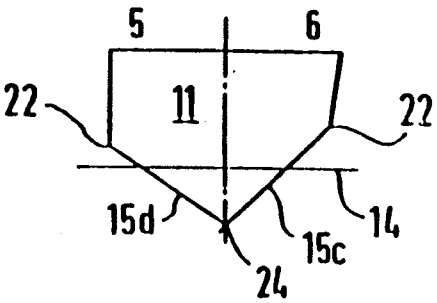

Whereas the bottom frames 13*a* of the lateral annexes 12 (FIG. 5) are separated from the knuckle line 22 of the central body 11 via a step 16 at the start of the lateral annexes, the bottom frames of the lateral annexes merge directly into the bottom frames of the central body 11 between the frames 3 and 4 as one can see in FIGS. 3 and 5 from the representations of the frames 0, 1, 2 and 3. The step 16 is merely recognisable at the frame 4 in FIG. 5.

Figure 2:
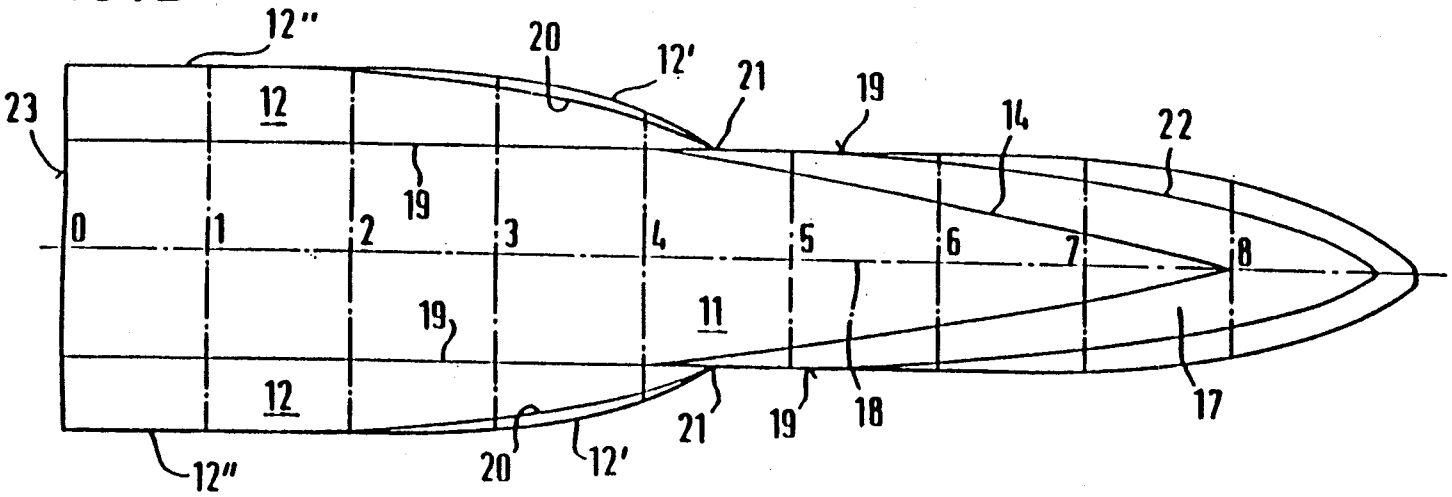

The lateral annexes 12 are made completely symmetrical to the longitudinal plane 18 of the ship (FIG. 2).

On the whole the following can be stated relating to the construction of the watercraft of the invention:

In the region of the tip 17 there is a pronounced V-frame which extends clearly above the line of flotation 14. Towards the center of the watercraft the V-shape of the central body 11 flattens off continuously so that the knuckle lines 22 continuously approach the line of flotation 14.

At the position where the knuckle lines 22 intersect the line of flotation 14 between the frames 4 and 5 the lateral annexes 12 project at an angle of approximately 30° to the stern out of the vertical and parallel side boundaries 19 of the central body 11 at the vertical knuckle line 21 and then merge via a rounded region 12' into the rear half of the lateral annexes 12 in a region 12'' where the sidewalls of the lateral annexes 12 extend parallel to one another up to the stern 23. In this region the bottom frames 13*e* of the lateral annexes 12 are practically horizontally aligned and they form an angle of approximately 170° with the bottom frames 15*i* of the central body 11.

Towards the foreship the inclinations of the bottom frames 15 of the central body and of the lateral annexes 12 become continuously closer to one another and in a specific region of the aftship, for example from frame 2 to approximately frame 3 (FIG. 4) the inclinations correspond so that a unitary base frame 13*c*, 15*g* and 13*b*, 15*f* (FIG. 5) arises in a single common plane.

What is claimed is:

1. A watercraft having a fore part and a stern longitudinally spaced therefrom, the watercraft comprising a central body including chine-type frames having V-shaped bottom frame sections which become relatively flatter on the frames from the fore part toward the stern of the watercraft, first and second, mutually symmetrical lateral annexes on the central body forming a structural unit therewith, the annexes also including chine-type frames, the lateral annexes extending in the longitudinal direction along the central body starting in a middle region thereof and extending rearwardly therefrom at least to the stern of the watercraft, the frames of the lateral annexes including bottom frame members of an inclination relative to a horizontal plane no greater than an inclination of the bottom frame sections relative to the horizontal plane of the central body in any given vertical frame plane of the watercraft, the lateral annex including a bottom surface shaped to provide a rise angle for the watercraft which changes gradually in a longitudinal direction, said rise angle on the annexes substantially corresponding to a rise angle of the central body at a longitudinal mid-region thereof and further amounting to 0° at the stern of the watercraft.

2. Watercraft in accordance with claim 1, characterised in that the lateral annexes (12) start in a central region of the central body (11).

3. Watercraft in accordance with claim 1, wherein the watercraft includes a sharpened foreship part (17) and the central body (11) has lateral boundaries (19) which extend parallel to one another and to a longitudinal plane (18) of the watercraft along the lateral annexes (12).

4. Watercraft in accordance with claim 1 wherein the lateral annexes (12) include knuckle lines projecting at an angle of 15° to 40° from a lateral boundary of the central body (11) and include a rounded portion leading to a widest section of the annexes.

5. Watercraft in accordance with claim 4, wherein the central body includes a vertical lateral boundary and the knuckle lines of the annexes merge into the lateral boundary via a substantially vertically oriented knuckle line (21).

6. Watercraft in accordance with claim 4 wherein said angle at which the knuckle line projects is in the range of between about 25° to 30°.

7. Watercraft in accordance with claim 1 wherein the bottom frame members (13*b* to 13*e*) of the lateral annexes merge steplessly over a major portion of the length of the lateral annexes (12) into the bottom frame sections (15*f* to 15*i*) of the central body.

8. Watercraft in accordance with claim 7, wherein the bottom frame members (13*a*) of the lateral annexes are only separated from the bottom frame sections (15*e*) of the central body in a forward region of the lateral annexes (12) by a substantially vertical step and are positioned above the latter.

9. Watercraft in accordance with claim 8 wherein the step (16) decreases in height continuously in a direction toward the stern and terminates in a central region of the central body.

10. Watercraft in accordance with claim 7 wherein the inclination of the bottom frame members and sections (13*a* to 13*c*, 15*e* to 15*g*) of the lateral annexes (12) and of the central body (11) is the same at the start and wherein the inclination of the bottom frame members (13*d*, 13*e*) of the lateral annexes to the horizontal plane in the vicinity of the stern is smaller than the inclination of the bottom frame sections (15*h*, 15*i*) of the central body.

11. Watercraft in accordance with claim 10, wherein the inclination of the bottom frame members (13*e*) of the lateral annexes is zero at the stern.

12. Watercraft in accordance with claim 10 wherein a difference in inclination between the bottom frame members (13*d*, 13*e*) of the lateral annexes and of the bottom frame sections (15*h*, 15*i*) of the central body is no greater than 20°.

13. Watercraft in accordance with claim 12 wherein said difference in inclination is in the range of between 10° to 15°.

14. Watercraft in accordance with claim 1 wherein the inclination of a bottom frame section (15*e*) of the central body to the horizontal plane in a region of the watercraft where the lateral annexes (12) start amounts to 10° to 45°.

15. Watercraft in accordance with claim 14 wherein said inclination of the bottom frame sections to the horizontal plane is about 30°.

16. Watercraft in accordance with claim 1 wherein the inclination of the bottom frame sections (15*i*) of the central body at the stern amounts to 10° to 45°.

17. Watercraft in accordance with claim 1 wherein the watercraft has a line of floatation which extends from the fore part to the stern, and including a knuckle line (22) of the bottom frame sections of the central body in the foreship region extending from a position clearly above the line of flotation (14) at the fore part continuously obliquely downwardly and intersecting the line of flotation (14) in the region of the start of the lateral annexes (12) at an angle of 15° to 25°.

18. Watercraft in accordance with claim 17, wherein the knuckle line (22) has an angle of 10° to 20° to the horizontal in the entire fore part of the watercraft.

19. Watercraft in accordance with claim 18, wherein the knuckle line (22) is slightly upwardly convexly curved in the fore part.

20. Watercraft according to claim 17 wherein said angle at which the knuckle line intersects the line of floatation is about 15°.

21. Watercraft in accordance with claim 1 wherein the bottom frame sections (15*a*, 15*b*) of the central body in the fore part of the watercraft have an inclination to a horizontal plane of 45° to 60°.

22. Watercraft in accordance with claim 1 wherein knuckle lines (20, 22) in a rear region of the watercraft extend to the stern (23) from a position at the level of a line of flotation (14) approximately at a middle of the watercraft.

23. Watercraft in accordance with claim 22, wherein the knuckle lines (20, 22) in the rear region of the watercraft are slightly convexly curved downwardly.

24. Watercraft in accordance with claim 23 wherein the knuckles lines of the bottom frame sections of the central body have a turning point aft of a center of the watercraft and at the start of the lateral annexes (12).

25. Watercraft in accordance with claim 23 wherein the knuckle line of the bottom frame sections in the rear region of the watercraft extends substantially straight in an aft direction.

26. Watercraft in accordance with claim 1 wherein a maximum width of each lateral annex (12) amounts to 25 to 50% of a maximum width of the central body (11).

27. Watercraft in accordance with claim 26 wherein the maximum width of each lateral annex is about 35% of the maximum width of the central body.

* * * * *